US005688162A

United States Patent [19]

Williams

[11] Patent Number: 5,688,162

[45] Date of Patent: Nov. 18, 1997

[54] BLAST WHEELS AND CAGES FOR BLAST WHEELS

[76] Inventor: Norman Lewis Williams, 49 Moss Bank Road, St. Helens, Merseyside. WA11 7DE, United Kingdom

[21] Appl. No.: 586,683

[22] PCT Filed: May 27, 1994

[86] PCT No.: PCT/GB94/01164

§ 371 Date: Jan. 24, 1996

§ 102(e) Date: Jan. 24, 1996

[87] PCT Pub. No.: WO94/27786

PCT Pub. Date: Dec. 8, 1994

[30] Foreign Application Priority Data

May 27, 1993 [GB] United Kingdom ..... 9311163
Jun. 14, 1993 [GB] United Kingdom ..... 9312238

[51] Int. Cl.[6] ..... B24C 5/06

[52] U.S. Cl. ..... 451/92; 451/94; 451/95; 451/97; 451/98; 451/38; 451/39

[58] Field of Search ..... 451/92, 94, 95, 451/97, 98, 38, 39

[56] References Cited

U.S. PATENT DOCUMENTS

| | | | |
|---|---|---|---|
| 2,077,637 | 4/1937 | Minich | 451/94 |
| 2,708,814 | 5/1955 | Straub | 451/95 |
| 3,653,239 | 4/1972 | Carpenter, Jr. | 72/53 |
| 4,333,278 | 6/1982 | Schutle et al. | 451/98 |
| 4,395,851 | 8/1983 | Watts | 451/98 |
| 4,565,035 | 1/1986 | Carpenter, Jr. et al. | 451/97 |
| 4,649,673 | 3/1987 | Van Huyssteen | 451/98 |
| 4,751,798 | 6/1988 | McDade | 451/98 |

*Primary Examiner*—Robert A. Rose
*Assistant Examiner*—George Nguyen
*Attorney, Agent, or Firm*—William R. Hinds

[57] ABSTRACT

A blast wheel assembly has a bladed rotor and an impeller which rotate together. A cage has an axial and angular wall including an aperture through which in use particulate material passes. The cross section of the aperture is irregular to control the uniformity of blast effect on a surface being treated. The assembly can be in a mobile or static machine. Various forms of aperture are described, the preferred form of which is of non-uniform shape as it extends angularly with respect to the cage axis, the aperture being of less cross-section in a region intermediate the angular end regions of the aperture.

9 Claims, 5 Drawing Sheets

BLAST WHEELS AND CAGES FOR BLAST WHEELS

This invention relates to blast wheels and cages for blast wheels,

SUMMARY OF THE INVENTION

According to this invention a cage for a blast wheel comprises an angularly and axially extending wall, and aperture means in the wall, the aperture means having a non-uniform shape as it extends angularly.

The aperture means may be of less cross-section (axial extent) in a region intermediate the angular end regions of the aperture.

The aperture means may have a closed periphery.

The aperture means may comprise two angularly spaced apertures. The apertures may be circular. The aperture means may comprise two spaced arrays of apertures. The arrays may be triangular.

The aperture means may have angularly spaced sides and a base side and the base side may be non-straight as viewed laterally. The base side may be convex.

The aperture means may be diabolo-section.

The aperture means may be symmetrical about an axial plane of the cage.

The aperture means may be non-symmetrical about an axial plane of the cage.

The aperture means may be non-symmetrical about an axial plane; for example of larger cross-section at one angular end than the other end.

A blast wheel may comprise a rotor assembly and a cage as above.

The rotor assembly may comprise a bladed element and an impeller.

The invention may be performed in various ways and some specific embodiments with possible modifications will now be described by way of example with reference to the accompanying drawings, in which:

DETAILED DESCRIPTION OF THE INVENTION

Figure 1:
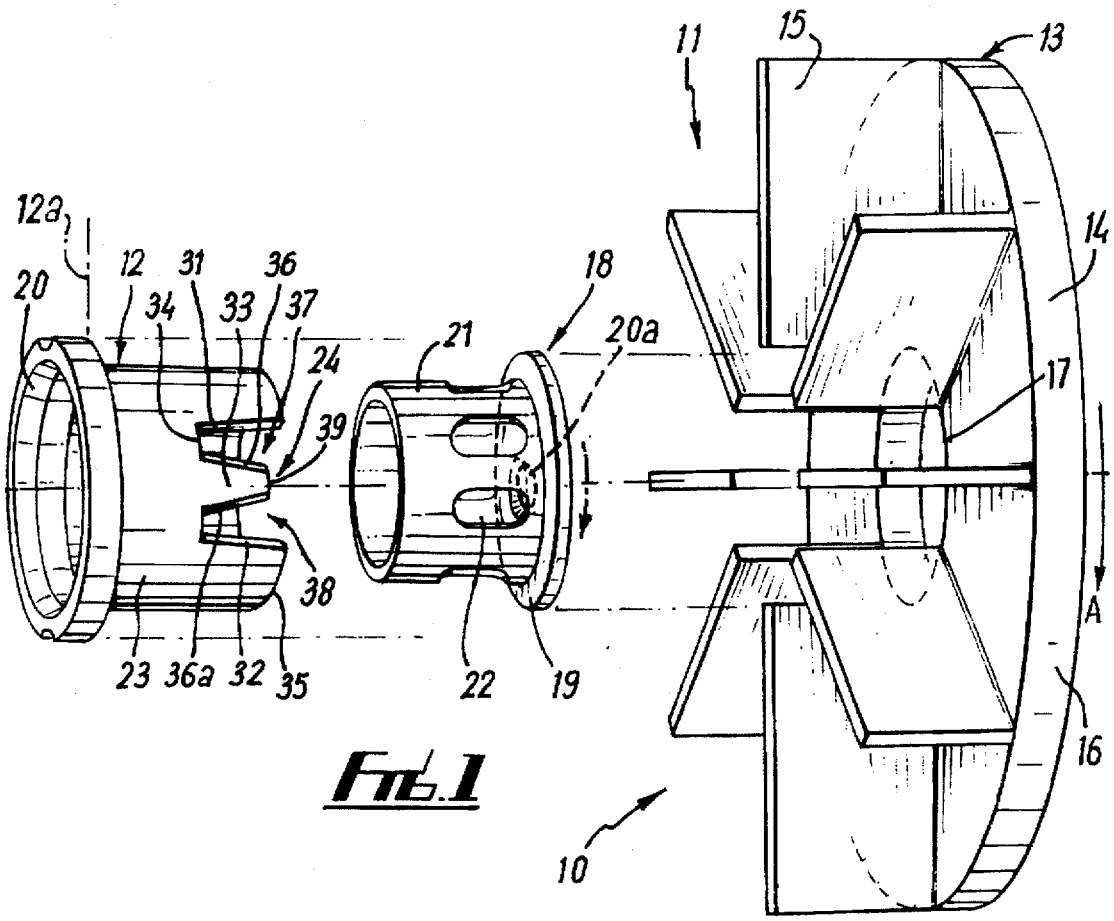
FIG. 1 is an exploded perspective view of a blast wheel.

A blast wheel 10 comprises a bladed rotor 11 and a cage 12. In use the rotor 11 is rotated relative to the cage 12.

The rotor 11 comprises a circular disc 13 one face 14 of which has a number of equiangularly spaced flat radial blades 15 extending between the outer rim 16 and a central aperture 17.

The rotor 11 includes an impeller 18. As shown, the impeller 18 has an end wall 19 secured to the disc 13 and the wall 19 has a central aperture 20*a*. A rotor shaft 20*b*, FIG. 2, locates in aperture 17 and the rotor and impeller are secured to the shaft by suitable means which close aperture 20*a*.

A circular wall 21 extends from one face of the wall 19 and includes a number of elongate apertures 22 disposed (FIG. 2) slightly in advance of the respective blade 15 with regard to the direction of rotation A.

The cage 12 is fixed for example to wall 12*a* shown and includes a circular wall 23 which surrounds the wall 21. The wall 23 includes an aperture or opening 24. The cage is shown chain-dotted in FIG. 2.

Figure 2:
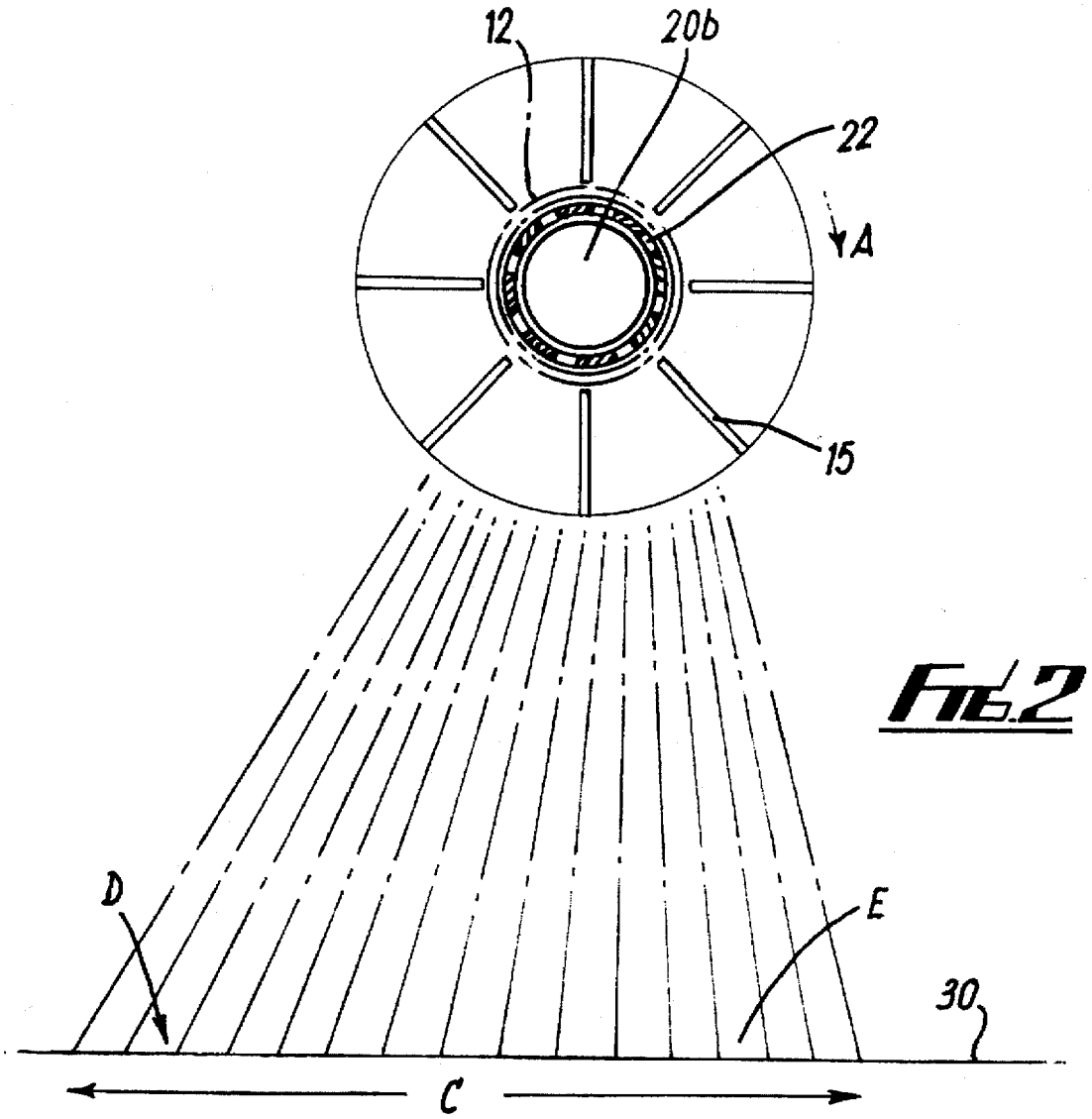
FIG. 2 is an axial view of part of the wheel.

In use, particulate material e.g. shot or grit is introduced through aperture 20 at the end of the cage 12 and passes through apertures 22, 24 and is flung out by the blades 15 somewhat as shown in FIG. 2 to hit a surface 30 to be treated.

In the present case the aperture 24 is shaped to enable the abrasive effect of the shot on the surface 30 to be more nearly even than if the aperture 24 were say a simple rectangle.

Thus, in FIG. 1, the aperture has angularly spaced parallel or, as shown, slightly converging, end faces 31, 32 and a central projection 33 extends from base edge 34 towards the disc 13 but stops short of a radial plane containing the end 35 of the wall 23.

The side faces 36, 36*a* of the projection 33 converge as they extend towards the disc 13.

Thus the aperture 24 is in effect two apertures 37, 38 connected by a portion 39 and is open on the side nearer disc 13.

Figure 3:
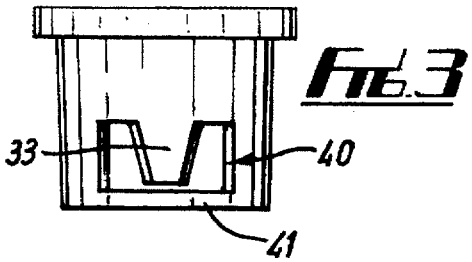
FIGS. 3 to 17 are side views of various cages.

In FIG. 3 the aperture 40 is similar but in this case the end is closed by wall 41.

Figure 17:
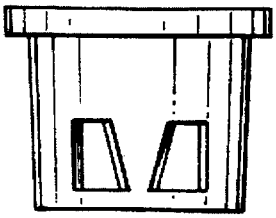

FIG. 17 is similar but the projection 33 extends to and is integral with wall 41.

Figure 4:
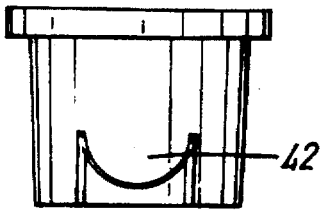
Figure 5:
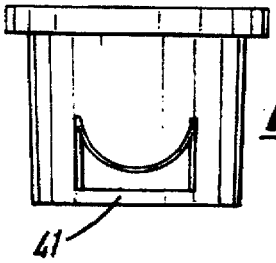

In FIG. 4 the projection 33 is a part-circle 42; and the opening has axial circumferentially spaced end walls. FIG. 5 is generally similar to FIG. 4 but includes wall 41.

Figure 6:
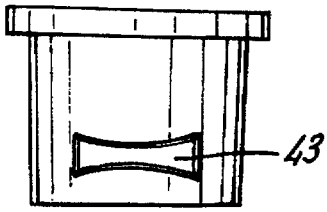

In FIG. 6 the aperture 43 is in the form of a diabolo section.

Figure 7:
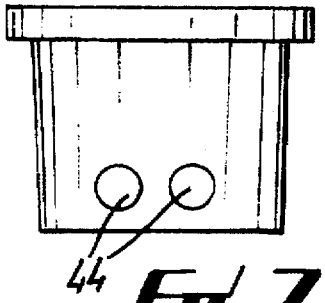

In FIG. 7 the aperture 24 is in the form of two angularly spaced equal circular apertures 44.

Figure 8:
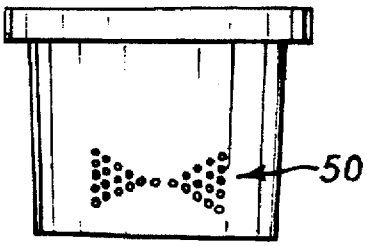

In FIG. 8 the aperture 24 takes the form of a plurality of apertures 50 arranged in the form of two triangular arrays with adjacent apices or with an aperture 50 between the apices.

In general the aperture means 24 of cages 12 in FIGS. 3 to 8 and 17 is symmetrical about an axial plane and is at least in part non-uniform in cross-section as it extends angularly.

The aperture means 24 in the examples shown in FIGS. 3 to 8 and 17 has a cross-section or axial extent which is less in a region intermediate, and in particular at the mid-point angularly, the angular end regions and is for reducing a hot spot in a central region of the area C on surface 30 which is being treated (as shown diagrammatically in FIG. 2) using a blast wheel cage with a uniform rectangular opening.

By appropriate shaping of the aperture means 24 any so-called hot spot on the surface being treated is reduced or removed to give a more even blast treatment.

Thus if there is a hot spot to one side of area C, the aperture 24 can be of greater cross-section at one angular end then the other.

Figure 9:
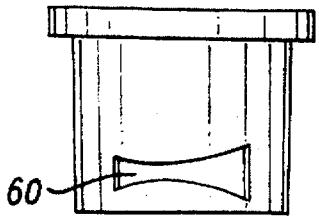

In FIG. 9 the angularly forward (with respect to the direction of rotation) end 60 of aperture 24 is of lesser cross-section and this reduces any hot spot in the region D (i.e. the forward portion with respect to the direction of rotation) of area C (FIG. 2). Similar apertures of greater cross-section at one angular end are shown in FIGS. 11 to 16.

Figure 10:
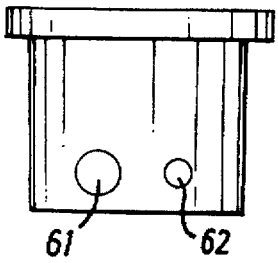
Figure 11:
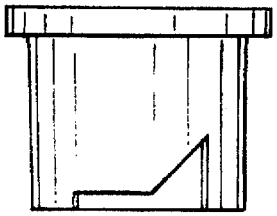
Figure 12:
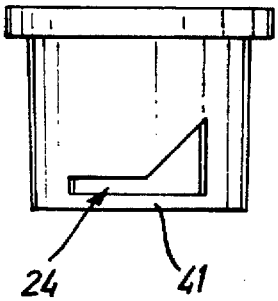
Figure 13:
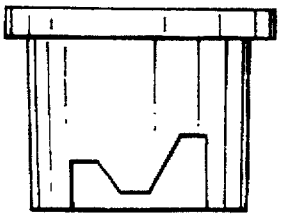
Figure 14:
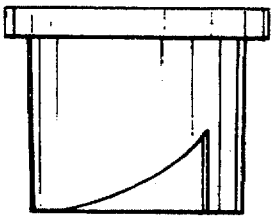
Figure 15:
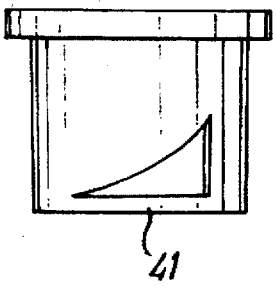
Figure 16:
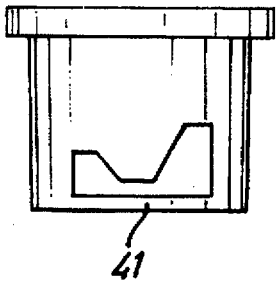

In FIG. 10 the (leading) aperture 62 is smaller than trailing aperture 61 and this may reduce a hot spot in region E of area C (FIG. 2) when the wheel rotates anti-clockwise as seen in FIG. 2. The apertures in the other cages of FIGS. 9 to 16 can be reversed for such anti-clockwise rotation.

In general, the angular and axial extent of the effective aperture 24 can be varied and the shape and extent of the projection 33 for example can be varied under test in a given circumstance to produce a desired result.

The blast wheel 10 can be used in both static machines and movable machines i.e. machines which move over the surface 30.

However, cages of FIGS. 3 to 8 and 17 are appropriate to a mobile machine and of FIGS. 9 to 16 to a static machine.

Figures 18, 18A:
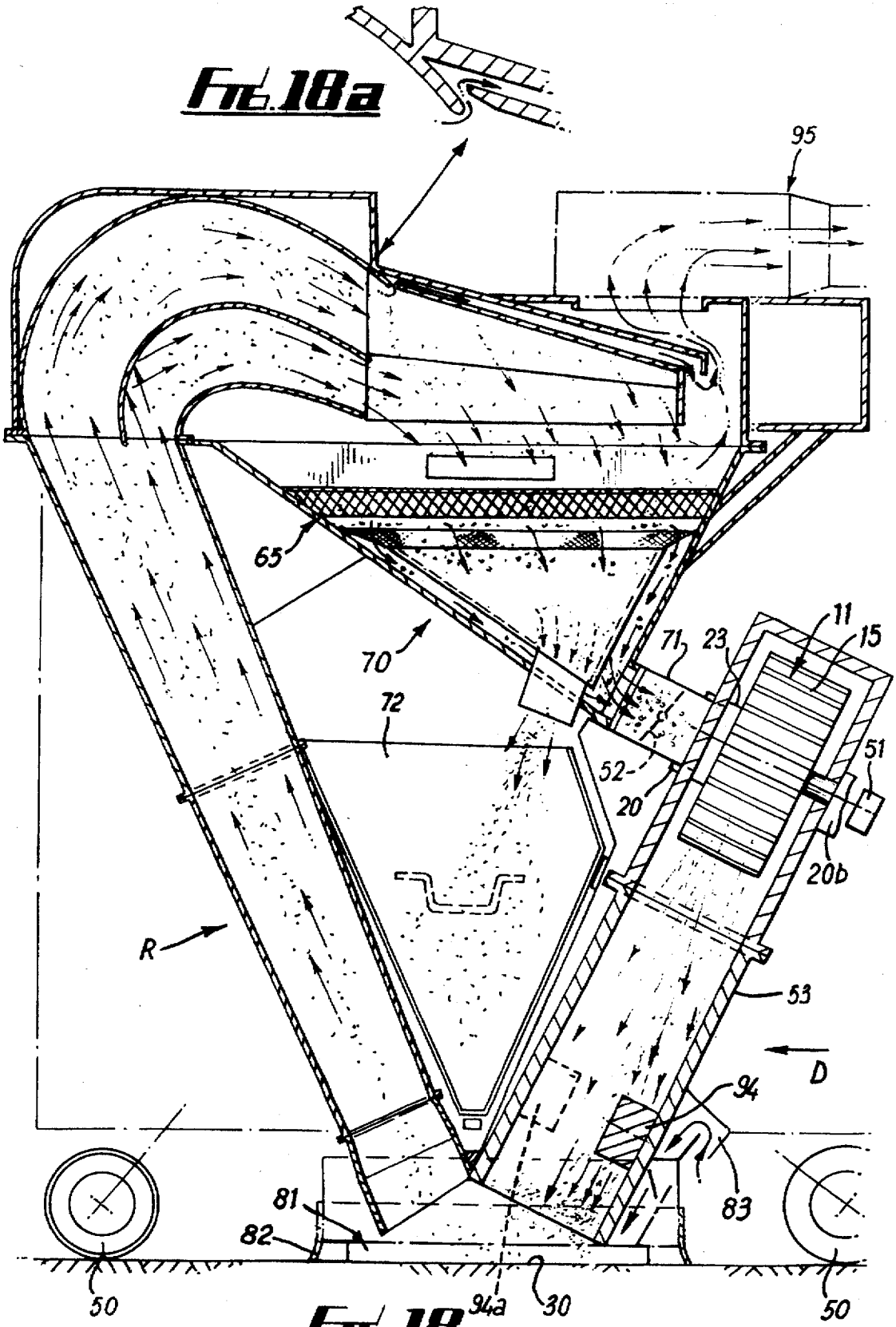
FIGS. 18, 18*a*, and 19 are diagrammatic views of blast apparatus.

Thus, in a mobile machine FIG. 18, movable on wheels 50 in direction D over surface 30, the blast wheel 11 is rotated by motor 51. Particulate material passes from reservoir 70 through channel 71 with control valve 52 to inlet 20 of cage 12. The particulate material is flung down delivery channel 53 to hit surface 30 and rebound with debris from surface 30 up return passage R to a filter arrangement 65 and thence the reservoir. The treatment or blast resin 81 may be surrounded by a flexible skirt 82. Air can be admitted at 83. Projections 94, 94*a* may be used to control the impact of the material on surface 30. Dust can be extracted at 95.

Figure 19:
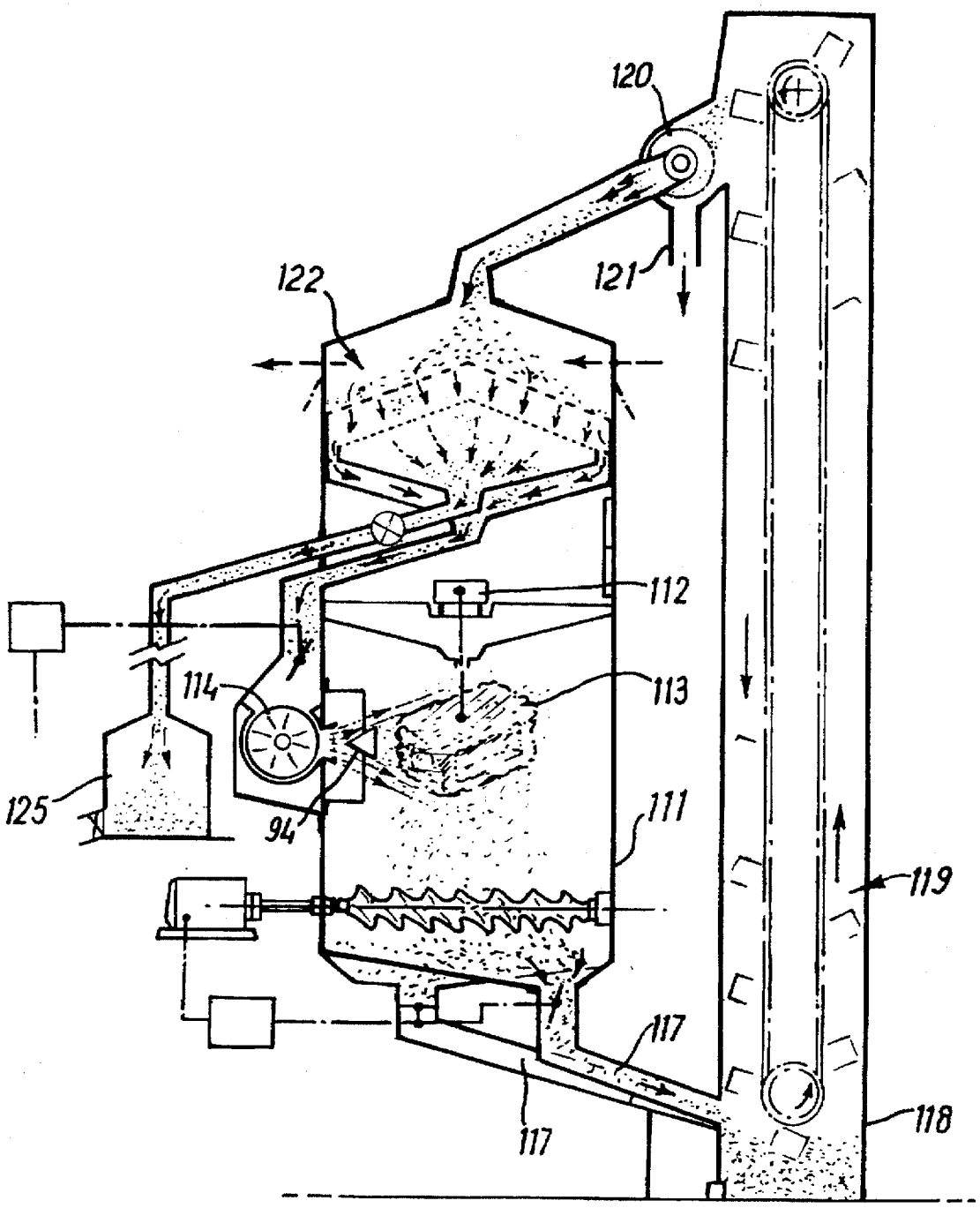

FIG. 19 shows a static machine in which articles 113 to be treated in chamber 111 are carried by conveyor 112 past blast wheel 114. A hopper 118 for particulate material has a bucket lift 119 to deliver the material to filter drum 120 and filter 122, thence to wheel 114 and after use through passage 117 to hopper 118. Debris can be removed at 121, 125.

In some cases with a static machine it may be desired to have a greater blast treatment at one side of the surface being treated in which case one angular end region of the aperture 24 can be of greater axial extent than the other.

Other forms of mobile and static machine can use the cages as described.

I claim:

1. A cage for a blast wheel, the cage having an axis and comprising a wall extending angularly about and axially with respect to the axis, and means defining an aperture in the wall, the aperture having a non-uniform shape as it extends angularly with respect to the axis, in which the aperture is of less cross-section in a region intermediate the angular end regions of the aperture.

2. A cage as claimed in claim 1, in which the aperture has a closed periphery.

3. A cage as claimed in claim 1, in which the aperture comprises two angularly spaced adjacent apertures.

4. A cage as claimed in claim 3, in which the two apertures are circular.

5. A cage as claimed in claim 3, in which each of the two apertures has four sides.

6. A cage as claimed in claim 1, in which the aperture comprises two spaced adjacent arrays of apertures.

7. A cage as claimed in claim 1, in which the aperture is symmetrical about an axial plane of the cage.

8. A cage as claimed in claim 1, in which the region is mid-way between the angular end regions.

9. A blast wheel comprising a rotor assembly and a cage as claimed in claim 1.

* * * * *